US005999072A

United States Patent [19]

Slavik

[11] Patent Number: 5,999,072

[45] **Date of Patent: *Dec. 7, 1999**

[54] ELECTRICAL SWITCH

[75] Inventor: William H. Slavik, Palos Hills, Ill.

[73] Assignee: Technical Products Group, Inc., Lombard, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/031,030

[22] Filed: Feb. 26, 1998

[51] Int. Cl.[6] ..... H01H 67/00

[52] U.S. Cl. ..... 335/207; 200/43.01

[58] Field of Search ..... 335/205–207, 335/151–4; 200/293–305, 333, 334, 43.01, 339, 335, 332, 43.16, 43.22

[56] References Cited

U.S. PATENT DOCUMENTS

| | | | |
|---|---|---|---|
| 957,953 | 5/1910 | Heinze, Jr. | 200/334 |
| 2,908,408 | 10/1959 | Reed, Jr. . | |
| 2,949,197 | 8/1960 | Lomen et al. . | |
| 3,185,790 | 5/1965 | Salerno . | |
| 3,483,492 | 12/1969 | Mirbeth . | |
| 3,887,092 | 6/1975 | Leet . | |
| 4,143,904 | 3/1979 | Cooper et al. . | |
| 4,339,747 | 7/1982 | Maybee | 340/547 |
| 4,358,150 | 11/1982 | Nash . | |
| 4,458,226 | 7/1984 | Cho | 200/6 A |
| 4,663,601 | 5/1987 | Troutman et al. | 335/207 |
| 4,806,062 | 2/1989 | Stier . | |
| 4,993,908 | 2/1991 | Park . | |
| 5,047,773 | 9/1991 | Seitsonen et al. | 341/176 |
| 5,134,259 | 7/1992 | Page, Jr. | 200/341 |
| 5,265,450 | 11/1993 | Doyle . | |
| 5,316,432 | 5/1994 | Smalley et al. . | |
| 5,436,605 | 7/1995 | Mrenna . | |
| 5,449,267 | 9/1995 | Ablabutyan . | |
| 5,451,089 | 9/1995 | Bender . | |
| 5,513,943 | 5/1996 | Lugash et al. . | |
| 5,653,568 | 8/1997 | Josephs . | |

*Primary Examiner*—Lincoln Donovan
*Attorney, Agent, or Firm*—Brinks Hofer Gilson & Lione

[57] ABSTRACT

An electrical switch includes a housing having walls extending continuously around a recess. A switch actuator is pivotally mounted in the housing in the recess and protected by the walls. First and second reed switches are mounted in the housing, and a magnet is mounted to the switch actuator and is pivotable between a first position, in which the magnet activates the first reed switch, and a second position, in which the magnet activates the second reed switch.

9 Claims, 3 Drawing Sheets

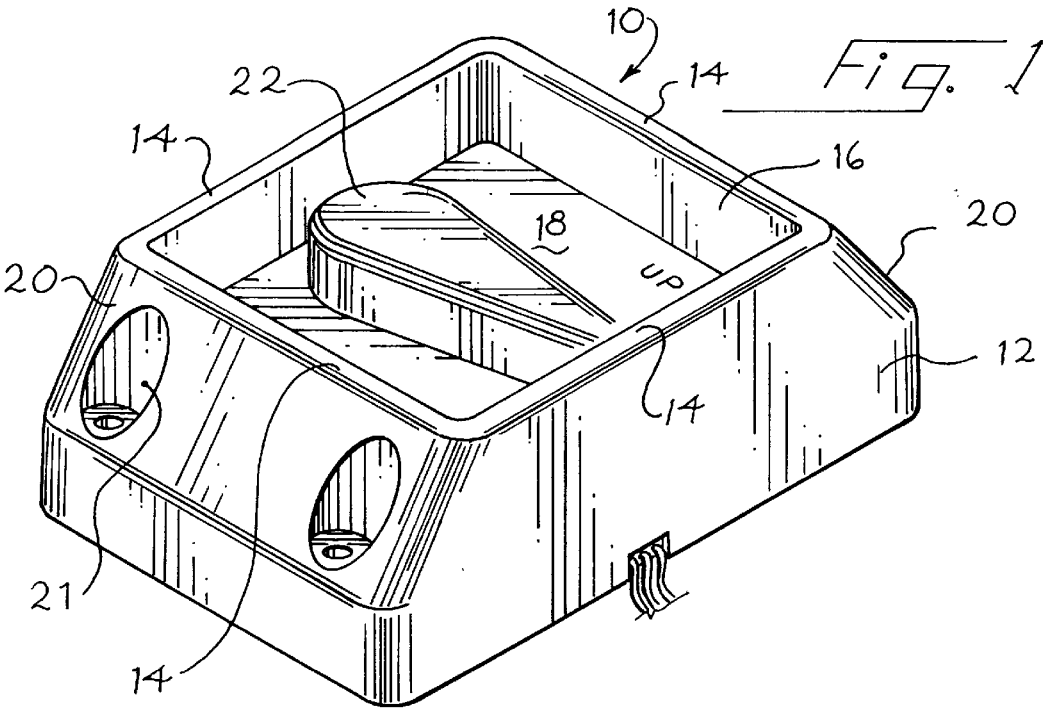
Fig. 1
Fig. 3
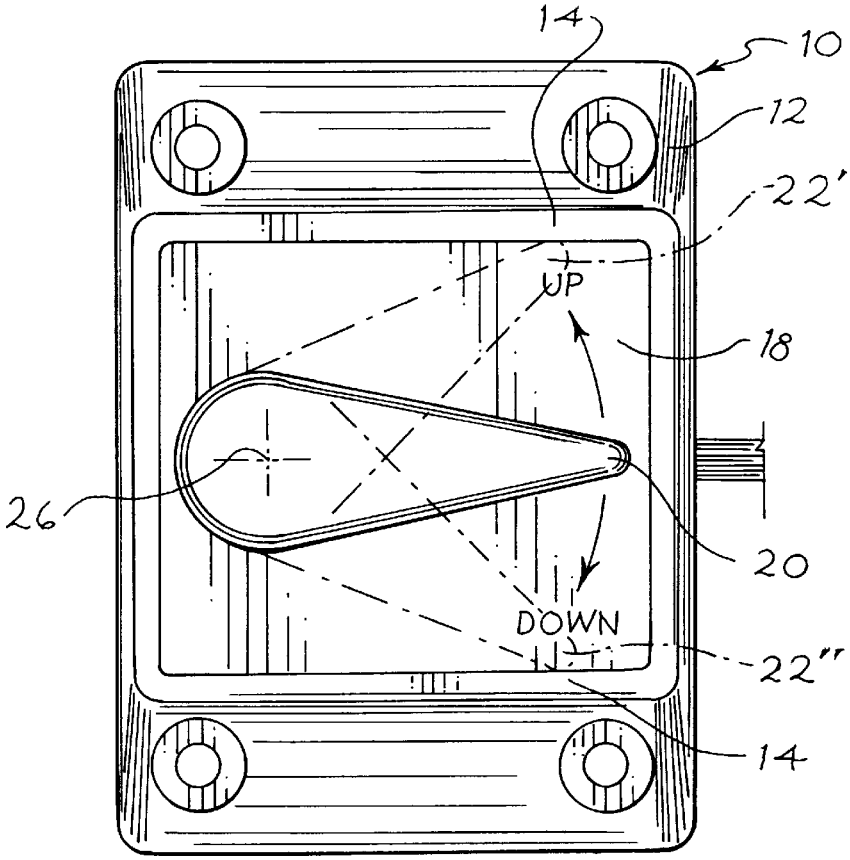

ELECTRICAL SWITCH

BACKGROUND

This invention relates to an electrical switch that is weatherproof and well protected against impacts and operator abuse.

Electrical switches are commonly used as control switches in outdoor applications. For example, a delivery truck may carry a hydraulically-powered lift gate, and electrical switches are typically provided on the outside of the delivery trucks to allow the driver to control the lift gate. Such electrical switches must operate reliably in a harsh environment. Any switch failure can cause such delivery truck to be stranded, particularly if the switch fails with the lift gate in the lowered position.

In the past, lift gate switches of this type have proven insufficiently rugged in use. Such switches are exposed at an exterior surface of the truck, and they are subjected to occasional impacts from moving objects. Furthermore, operator abuse may disable a switch if it is not properly designed. Weather-proofness is another important characteristic of such switches.

SUMMARY

The present invention is directed to an improved electrical switch that meets the operational objectives discussed above. The switch of this invention is defined by the following claims, and nothing in this summary should be taken as a limitation on those claims.

By way of introduction, it can be stated that the electrical switch described below pivotably mounts a switch actuator in a recess defined by a rigid housing. The walls of the housing around the recess protect the switch actuator from impact with moving objects, and the walls around the recess also limit the range of travel of the actuator, thereby protecting the actuator and the switch components from over travel. In the preferred embodiment described below, the switch actuator carries a magnet, and the housing carries first and second reed switches. The switch actuator is pivotable between a first position, in which the magnet activates the first reed switch, and a second position, in which the magnet activates the second reed switch.

BRIEF DESCRIPTION OF THE DRAWINGS

FIG. 1 is a perspective view of an electrical switch that incorporates a preferred embodiment of this invention.

FIG. 3 is a top view of the switch of FIG. 1 showing the switch actuator in three alternative positions.

DETAILED DESCRIPTION OF THE PRESENTLY PREFERRED EMBODIMENT

Figure 2:
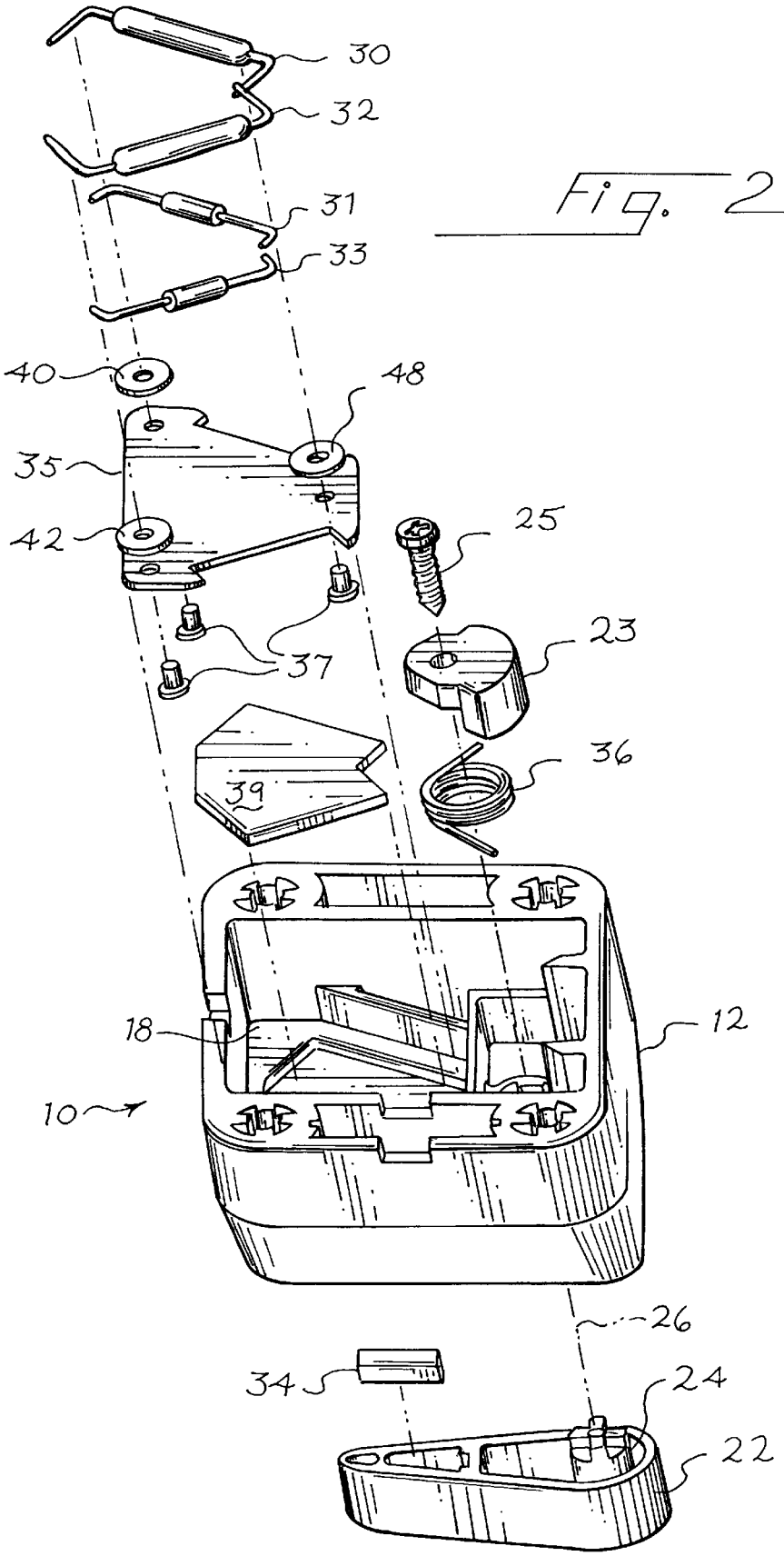
FIG. 2 is an exploded perspective view of the switch of FIG. 1 from below.

Turning now to the drawings, FIG. 1 shows a perspective view of an electric switch 10 that includes a rigid housing 12 and a switch actuator 22.

The rigid housing 12 includes four walls 14 that extend continuously around a recess 16. The lower portion of the recess 16 is defined by a recessed surface 18. As shown in FIG. 1, two of the walls 14 include sloped portions 20 that are shaped to deflect impacted objects. Openings 21 are provided for mounting fasteners (not shown).

As best shown in FIG. 2, the actuator 22 includes a shaft 24 that is mounted for pivotal motion in the housing 12 about an axis of rotation 26. A magnet 34 is secured to the actuator above the surface 18, and a spring 36 is disposed around the shaft 24. This spring 36 reacts against both the housing 12 and a protruding collar 23 carried by the shaft 24 to bias the actuator 22 to the central position shown in FIG. 1. A screw 25 secures the collar 23 to the shaft 24 to hold the assembly together.

Figure 4:
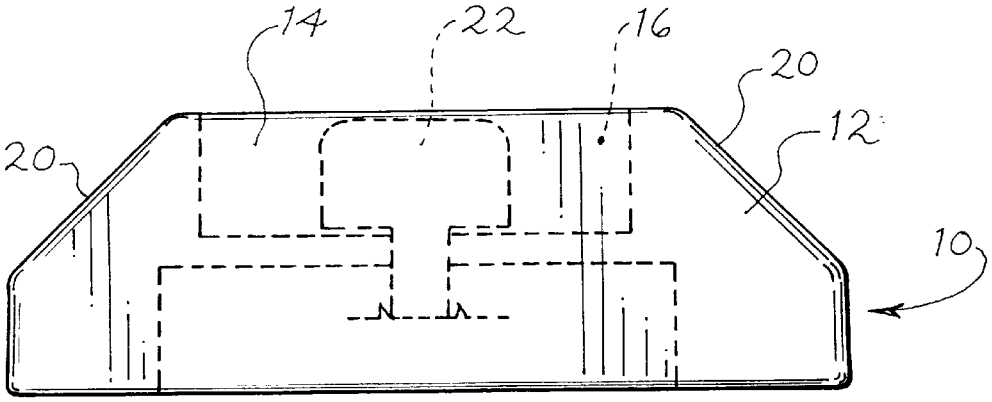
FIG. 4 is a side view of the switch of FIG. 1.

As shown in FIG. 4, the actuator 22 is disposed completely within the recess 16, and the walls 14 therefore protect the actuator 22 from impacting objects. Furthermore, as shown in FIG. 3, the axis 26 is positioned peripherally in the recessed surface 18 and pivoting movement of the actuator 22 about the axis 26 is limited by the walls 14. In FIG. 3, the dotted outlines 22', 22" show the actuator 22 at the two extremes of travel, in which the end of the actuator 22 is in contact with the respective walls 14, and the walls 14 restrain the actuator 22 against further pivotal movement. Thus, the walls 14 limit the pivoting range of travel of the actuator 22 and thereby protect the actuator 22 and other components of the switch 10 from over-rotation by the operator.

As best shown in FIG. 2, first and second reed switches 30, 32 are mounted in a lower portion of the housing 12. Each of the reed switches 30, 32 has a first contact in electrical communication with a common terminal 48, as well as a second, switched contact, in contact with first and second switched terminals 40, 42, respectively. In FIG. 3 the solid line outline of the actuator 22 shows the position of the actuator in a central position, in which neither of the reed switches 30, 32 is activated. The dotted line outline 22' shows the actuator in an upper position at an extreme of travel. In this position the magnet 34 is aligned with the first reed switch 30, and the first reed switch 30 is activated (closed in this example). Similarly, the dotted line outline 22" shows a lower position of the actuator in which the magnet 34 is aligned with the second reed switch 32, and the second reed switch 32 is activated (closed in this embodiment).

Figure 5:
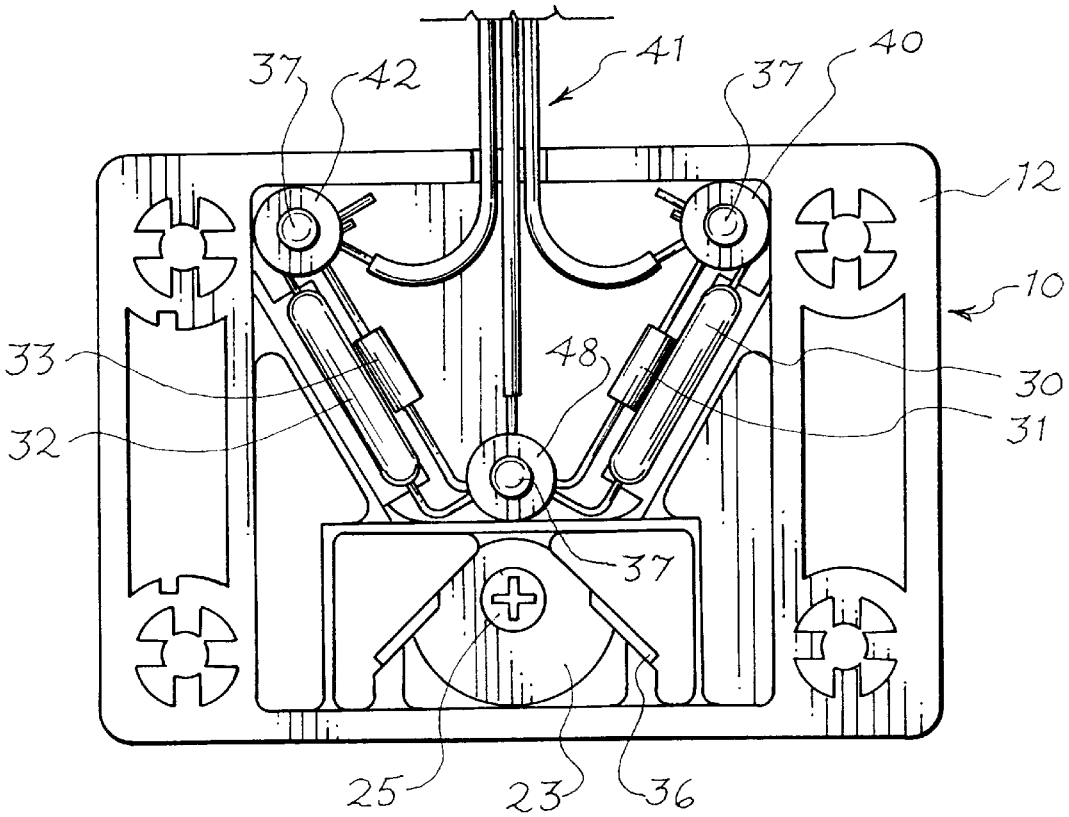
FIG. 5 is a bottom view of the switch of FIG. 1 with selected elements removed for clarity of illustration.

As shown in FIG. 2, the reed switches 30, 32 and associated diodes 31, 33 are mounted on an assembly plate 35 by rivets 37. A metallic magnetic shunt 39 is mounted in the housing 12 beneath the assembly plate 35 to shield the reed switches 30, 32 from unintended activation when the magnet 34 is in the central position. Preferably, the magnetic shunt 37 and the assembly plate 35 with its associated components are potted in place in a lower recess of the housing 12, using conventional potting materials. FIG. 5 shows the assembly without potting materials, showing conductors 41 connected to respective ones of the terminals 40, 42, 48 by the rivets 37.

The electrical switch 10 is rugged and weather-proof. The rigid housing 12 protects the actuator 22 against impacting objects as well as against over-rotation. The reed switches 30, 32 are hermetically sealed, and therefore weather-proof. By way of example, the housing 12 can be formed of a fiber-reinforced thermoplastic material such as that sold under the trade name VALOX 420.

Various modifications can be made to the switch 10 described above. For example, the actuator can be mounted to slide rather than pivot with respect to the housing, and the actuator can be formed as push buttons, if desired. Furthermore, the reed switches and magnet described above can be replaced with one or more mechanical switches, as long as the mechanical switches are properly sealed to provide the desired weather-proofness. It is not essential in all embodiments that the walls extend continuously around the recess, and if desired the walls can extend partly around at least three sides of the recess. Similarly, one or more gaps can be formed in the walls. Materials and proportions can all be changed as suitable for the intended application.

As used herein, the term "activate" is intended broadly to encompass both the opening of a normally closed switch and the closing of a normally open switch.

The foregoing detailed description has discussed only a few of the many forms that the present invention can take. For this reason, this detailed description is intended as illustrative and not as limiting. It is only the following claims, including all equivalents, that are intended to define the scope of this invention.

I claim:

1. An electrical switch comprising:

a housing comprising a recessed surface and at least one wall disposed at least partly around the recessed surface, the recessed surface and the at least one wall cooperating to form a recess in an outer portion of the housing;

a switch mounted in the housing; and a switch actuator coupled with the switch and mounted in the recess to pivot about an axis oriented substantially perpendicular to the recessed surface, said switch actuator comprising an operating lever that pivots between a first extreme of travel, at which the operating lever contacts a first portion of the at least one wall, and a second extreme of travel, at which the operating lever contacts a second portion of the at least one wall; said operating lever manually accessible in the recess from outside the housing; said first and second portions of the at least one wall limiting pivoting movement of the operating lever and protecting the switch against over-rotation.

2. The invention of claim 1 wherein the switch comprises first and second reed switches, and wherein the actuator comprises a magnet.

3. The invention of claim 2 wherein the magnet is positioned in the actuator such that the magnet activates the first reed switch when the operating lever is in the first extreme of travel, and the magnet activates the second reed switch when the operating lever is in the second extreme of travel.

4. The invention of claim 3 wherein the at least one wall is at least in part outwardly sloped for deflecting objects that may impact the housing.

5. The invention of claim 3 further comprising a spring reacting between the switch actuator and the housing to bias the switch actuator to a third position, in which the magnet activates neither the first reed switch nor the second reed switch.

6. The invention of claim 1 wherein the axis is positioned peripherally in the recessed surface near the at least one wall.

7. The invention of claim 1 wherein the at least one wall extends beyond the switch actuator such that the switch actuator is completely recessed in the housing.

8. The invention of claim 1 wherein the housing comprises a plurality of openings configured to receive mounting fasteners, said openings positioned on outer surfaces of the at least one wall.

9. The invention of claim 1 wherein the housing comprises a fiber-reinforced thermoplastic material.

* * * * *